United States Patent [19]

Curran

[11] Patent Number: 4,506,660

[45] Date of Patent: Mar. 26, 1985

[54] MASSAGING DEVICE

[76] Inventor: William F. Curran, 85 Dobson Rd., Mars, Pa. 16046

[21] Appl. No.: 360,791

[22] Filed: Mar. 22, 1982

Related U.S. Application Data

[63] Continuation-in-part of Ser. No. 264,432, May 18, 1981, abandoned.

[51] Int. Cl.[3] ..... A61H 15/00

[52] U.S. Cl. ..... 128/57

[58] Field of Search ..... 128/24.3, 38, 52, 57–61, 128/70–74; 5/66–68; 297/406, 410

[56] References Cited

U.S. PATENT DOCUMENTS

| | | | |
|---|---|---|---|
| 2,193,882 | 3/1940 | Petersen | 128/52 |
| 2,446,078 | 7/1948 | Niblack | 128/57 |
| 3,882,856 | 5/1975 | Heuser et al. | 128/57 |
| 3,998,218 | 12/1976 | Lane et al. | 128/70 |
| 4,190,043 | 2/1980 | Thompson | 128/57 |

FOREIGN PATENT DOCUMENTS

| | | | |
|---|---|---|---|
| 3026941 | 2/1982 | Denmark | 128/57 |
| 2947277 | 5/1981 | Fed. Rep. of Germany | 128/57 |
| 3036467 | 5/1982 | Fed. Rep. of Germany | 128/57 |
| 3105161 | 8/1982 | Fed. Rep. of Germany | 128/57 |

*Primary Examiner*—Richard J. Apley
*Assistant Examiner*—David J. Brown
*Attorney, Agent, or Firm*—Arnold B. Silverman

[57] ABSTRACT

A massaging device adapted to engage and apply massaging action to a supported body portion, such as the rear neck or cervical spine. The massaging device may have a base portion and an upper portion supported by the base portion. An upper portion has a body support portion. The upper portion in one form has a pair of spaced body support portions disposed on opposite sides of a plurality of roller members which are operatively associated with a main drive shaft driven by a motor with or without interposed speed reduction means. The body support portions are adapted to be adjusted in respect of relative spacing therebetween. Adjusting of the relative height of the body support portions with respect to the base portion and as a result with respect to the roller members may also be provided. Another embodiment has a body support portion in overlying contact with the roller members.

16 Claims, 8 Drawing Figures

MASSAGING DEVICE

CROSS REFERENCE TO RELATED APPLICATION

This application is a continuation-in-part of U.S. patent application Ser. No. 264,432, filed May 18, 1981, entitled "MASSAGING DEVICE" now abandoned.

BACKGROUND OF THE INVENTION

1. Field of the Invention

This invention relates to a massaging device and, more specifically, a massaging device which is uniquely adapted to be used by an individual with the device resting on a suitable support, such as a floor, and particularly suited to engage the cervical spine or rear neck portion of the body.

2. Description of the Prior Art

The beneficial aspects of massage as applied to the human body have been known for many years.

With respect to various muscular body ailments, as well as neurological ailments, well skeletal problems, the beneficial effects of manipulation and massage administered by a skilled practitioner, such as a chiropractor, have long been known.

Various devices which are adapted to provide massage by means of mechanical devices have been known. In general, these devices contemplate a hand-held unit having an electrically energized motor which creates movement of portions of the device which are adapted to come in contact with the human body. See, for example, U.S. Pat. Nos. 2,003,272; 2,384,427; 2,629,374; 3,297,024 and 4,127,116.

In general, these devices, while perhaps suitable for limited use in connection with local application to particular muscle regions which are readily accessible by an individual employing a hand-held device, these devices have not been suited for use on regions such as the rear of an individual's head, the rear of the neck or cervical spine regions without the assistance of a third party. These regions are of particular concern in respect of relief from extracranial headaches which are, to a great extent, triggered by muscular tension in the rear neck region.

There remains, therefore, a very real and substantial need for a massaging device which is adapted to provide the capability on the part of the an individual to apply mechanized massage of an appropriate type to this region of the body.

SUMMARY OF THE PRESENT INVENTION

The above-described need has been met by the present invention. In the present invention, the user is provided with a self-supporting automated massage device which is adjustable in order that the individual may assume a prone position with the head and adjacent body portion supported in a comfortable fashion with the massaging device engaging the rear neck portions to an extent which may also be adjustable.

The massaging device includes a base portion, an upper portion supported by the base portion with the upper portion having at least one body support portion. In a preferred embodiment, a plurality of roller members are disposed adjacent to and preferably between a pair of body support portions and are adapted to be positively driven in an orbiting path about a main drive shaft. Adjustment means permit ready adjustment of spacing between the body support portion. Additional adjustment means permit adjustment of the relative height of the body support portions with respect to the base portion, which preferably supports the roller assembly.

It is object of the present invention to provide an improved, automated massaging device which may readily be employed by an individual without the assistance of others.

It is a further object of the present invention to provide such a massaging device which is adjustable for maximum comfort of the individual using the same, as well as maximum efficiency of massaging action.

It is a further object of the present invention to provide a self-supporting automated massaging device which is adapted to provide massaging action to the cervical spine regions of the human body.

It is a further object of the present invention to provide such a massaging device which is economical to manufacture and simple to employ and maintain.

These and other objects of the present invention will be more fully understood from the following description of the invention on reference to the illustrations appended hereto.

DESCRIPTION OF THE PREFERRED EMBODIMENTS

Figure 1:
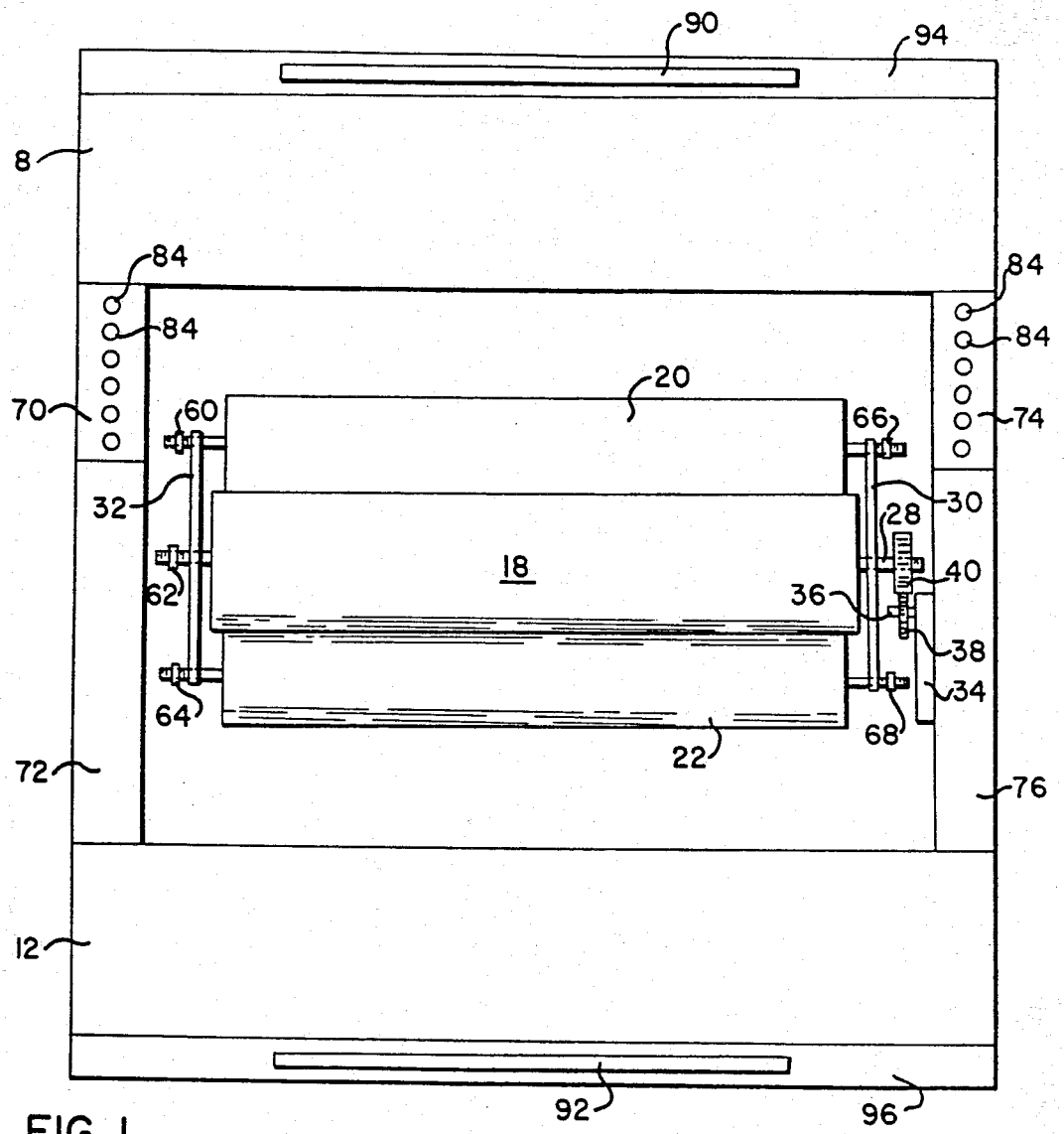
FIG. 1 is a partially schematic plan view of one form of apparatus of the present invention.
Figure 2:
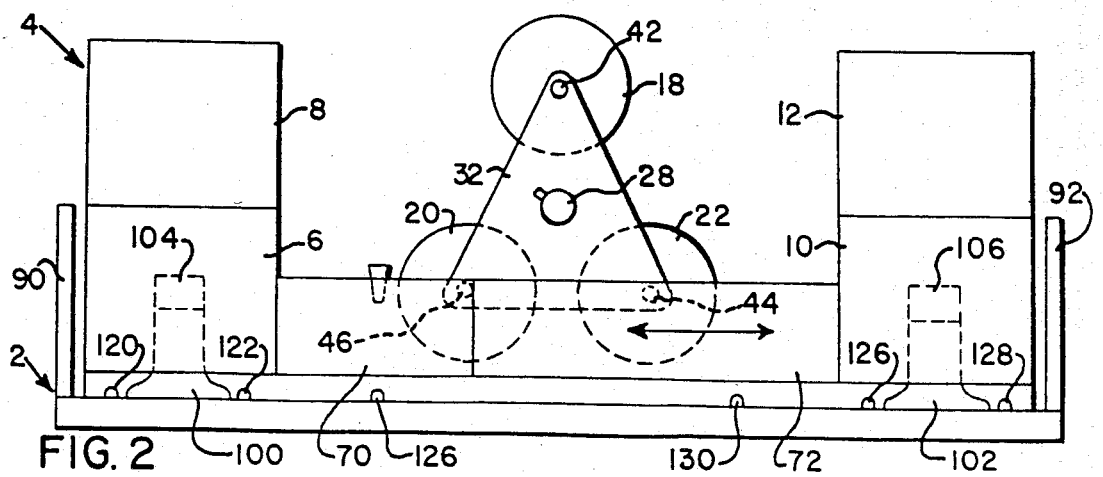
FIG. 2 is a side elevational view, partially schematic, of a form of the massaging device illustrated in FIG. 1.

Referring now in greater detail to FIGS. 1 and 2 there is shown a first embodiment of the massaging device of the present invention. In this embodiment, the massaging device has a base portion 2 which has a substantially flat lower surface in order that it may rest on a floor or other suitable supporting member. The upper portion 4, in a fashion to be described hereinafter in greater detail, cooperates with and rests upon the base portion 2. It is contemplated that the massaging device of the present invention, when in use, will be suitably positioned on a supporting surface and an individual may then place his or her cervical spine or rear neck portion or other portion of the body in suitable relationship to the supporting surfaces and roller members so as to achieve the desired massaging action.

In the form shown in FIGS. 1 and 2 the device has a pair of spaced body supporting portions. These consist of a substantially rigid lower portion 6, 10 and an overlying generally resilient portion 8, 12 to which the base portions, respectively, 6, 10 are secured. In this fashion, with appropriate spacing, an individual may place a portion of the rear of the head on support portion 12, for example, and an adjacent portion of the body on support portion 8 with the resiliency of the material providing for comfortable support. In this fashion, the roller members when rotation is initiated, will provide the desired massaging action to the rear of the neck or cervical spine.

Figure 3:
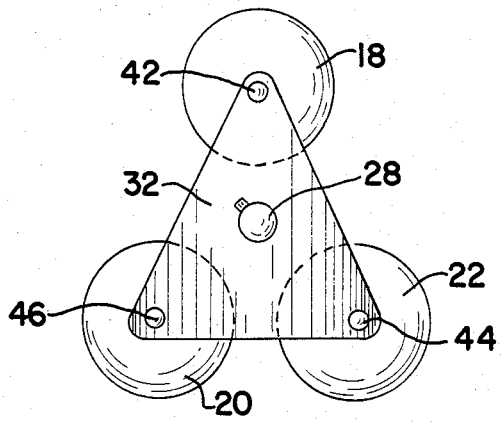
FIG. 3 is a fragmentary end illustration of a form of roller member assembly of the present invention.

Referring now to FIGS. 1 through 3 in greater detail, there is shown a system employing three roller members 18, 20, 22 which are adapted to contact the desired body portion. As for some uses, it may be desired to cover the roller portions with a suitable web such as a rubber or vinyl material (not shown) or to interpose such a web between the rollers and the body, the term "contact" as used herein in referring to contact between the human body and a roller shall be deemed to include direct or indirect contact. Also, while for purposes of illustration the preferred use of three rollers is illustrated, it will be appreciated that any desired number of rollers may be employed, with about two to seven being preferred.

Rollers 18, 20, 22 are supported by roller shafts 42, 46, 44, respectively. Main drive shaft 28 is keyed to generally triangular plates 30, 32 which are disposed adjacent to opposed ends of rollers 18, 20, 22 in such fashion that rotation of main drive shaft 28 will effect responsive rotation of plates 30, 32 and orbital movement of rollers 18, 20, 22 about shaft 28. In one embodiment of the invention, the rollers 18, 20, 22 will be fixedly secured to their respective shafts 42, 46, 44 and the shafts will be rotatably journaled within openings in plates 30, 32. As a result, rotation of main drive shaft 28 will create both orbital movement of the rollers 18, 20, 22 about the central longitudinal axis of shaft 28 and rotational movement of the roller members 18, 20, 22 about their own shafts 42, 46, 44. If desired, the roller members 18, 20, 22 may be rotatably mounted on shafts 42, 46, 44, respectively. It will be appreciated, therefore, that rotational movement of main drive shaft 28 effects both orbital and axial rotation of the rollers 18, 20, 22. This provides soothing massaging contact with the cervical spine or rear neck regions thereby relieving muscle tension and tending to eliminate muscular and extracranial headache discomfort. Relief to other portions of the body may also be provided through contact with the rotating rollers 18, 20, 22.

Any convenient means may be employed to secure plates 30, 32 to the shafts 42, 46, 44. In the form illustrated, the ends of the roller shafts have been threaded with nuts 60, 66 securing shaft 46 to plates 30, 32; nuts 64, 68 secure shaft 44 to plates 30, 32 and nuts 62, 63 (not shown in FIG. 1) secure shaft 42 to plates 30 and 32. It will be appreciated that other means for securing the shafts 42, 44, 46 to plates 30, 32 may be employed. For example, circumferential grooves in the shafts may be engaged by enlarged horseshoe-shaped, resilient clip members.

It will be appreciated that suitable support means which may advantageously be secured to base portion 2 and project upwardly therefrom contain journals to secure and support end portions of main drive shaft 28. For clarity of illustration these have not been shown, but may consist merely of suitable bearings which are supported by post or column members rigidly secured to base member 2. Such bearing members are indicated schematically by the numbers 80, 82 in FIG. 4.

Figure 4:
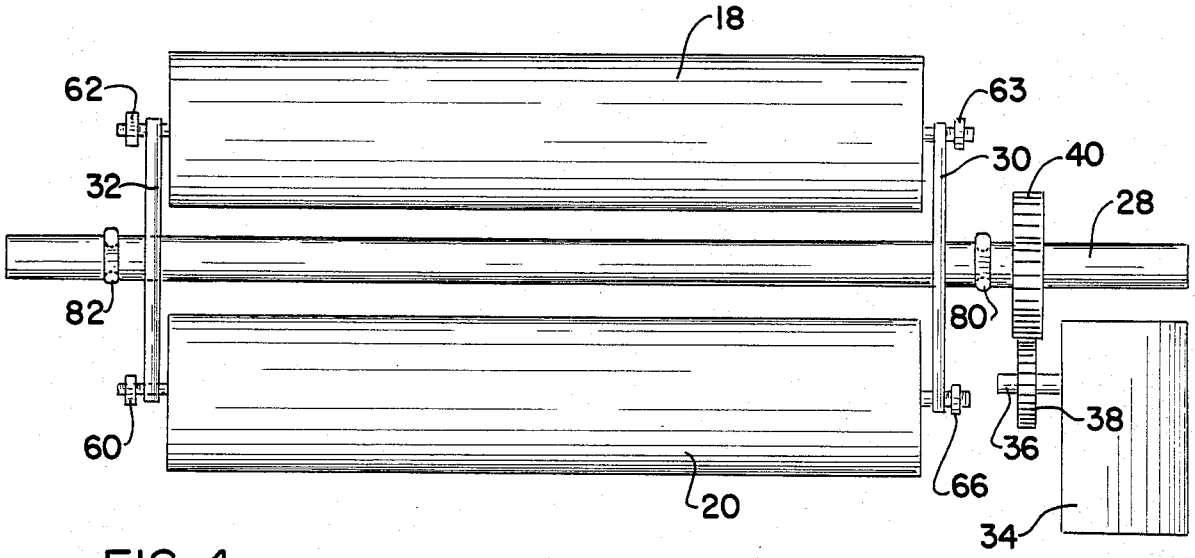
FIG. 4 is a side elevational view of a form of roller drive assembly of the present invention.

Referring to FIGS. 1 and 4, in the form shown, electric motor 34 of suitable output capacity has output shaft 36 fixedly secured to gear 38 which in turn meshes with gear 40 which is fixedly secured to main drive shaft 28. In this fashion, the output of motor 34 is used to rotate main drive shaft 28 with desired speed reduction being effected. Suitable switch means (not shown) are employed to initiate and terminate operation of the device through energizing and deenergizing the motor 34.

Figure 5:
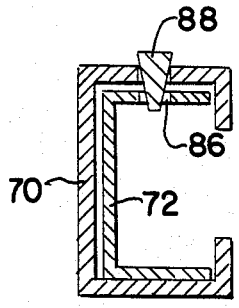
FIG. 5 is a fragmentary cross sectional illustration showing one form of adjustment means of the present invention.

In order to provide for maximum comfort and efficiency of use, first adjustment means which permits adjusting the relative spacing between body support portions 6–8 and 10–12 are provided. Referring to FIGS. 1, 2 and 5, a preferred means for providing this feature will be considered. Side portions 70, 74 are generally channel shaped and have reentrant flanges and a series of holes 84. Side members 72, 76 are of generally the same shape, respectively, as members 70, 74. Side member 72 is telescopingly received within side member 70 and member 76 is telescopingly received within member 74. As side members 70, 74 are fixedly secured to lower support portion 6 and side members 72, 76 are fixedly secured to lower support portion 10, it will be appreciated that by aligning a hole 84 of each side member 70, 74 with a hole 86 of each side member 72, 76 and inserting a removable peg-like element 88, the relative spacing between the upper support portions 8, 12 may be established at predetermined desired increments. If desired, the holes 84, 86 may be provided on only one side of the device or a single hole in lieu of a series may be provided on one of the two telescoping members. Other means of maintaining the adjusted position may be employed, if desired. For example, members 70, 74 may be provided with an integral, deformable tab which may be deformed into an opening 86. Also, while the channel-shaped side members 70, 72, 74, 76 have been shown with their openings facing generally inwardly, the openings may face downwardly or outwardly, if desired.

As the upper support portions 8, 12 are preferably generally resilient and the roller assembly is fixedly secured to base 2, it is preferred to provide second adjustment means in order to adjust the upper support members 8, 12 with respect to base 2 thereby controlling the depth of penetration or contact between the rollers 18, 20, 22 with the overlying body portion. As is shown in FIG. 2, foot members 100, 102 rest on the upper surface of base 2 and are externally threaded and received respectively, within threaded bores 104, 106. Similar feet and threaded bores are provided in connection with the other end of base-support portions 6, 10 in order to provide four such feet adjustably supporting the upper portion 4. By establishing relative rotational movement between a foot 100, 102 and its associated bore 104, 106, the extent of downward projection of the foot is controlled as is the position of the upper surface of upper support members 8, 12.

In order to minimize the likelihood of undesired relative lateral movement of upper portion 4 on base portion 2, a series of upwardly projecting, elongated members in the form of ribs 120, 122 spaced at a distance slightly greater than the width of foot 100 serve to confine the foot 100 within this region. Similarly ribs 126, 128 confine foot 102. Similar ribs are provided in connection with the other two feet (not shown in these figures). Should it be desired to move the body support portions 8, 12 to a relatively closer position, foot 100 may be placed between ribs 122, 124 and/or foot 102 may be moved to a position between ribs 126, 130.

Still referring to FIGS. 1 and 2, upwardly projecting walls 90, 92 are secured to base portion 2 and serve to further resist undesired lateral movement of the upper portion 4 with respect to base portion 2 as well as resisting undesired contact between the user and the internal moving parts of the device. Similar walls (not shown) may be provided on extensions of base 2 adjacent sidewalls, 70, 72, 74, 76.

Figure 6:
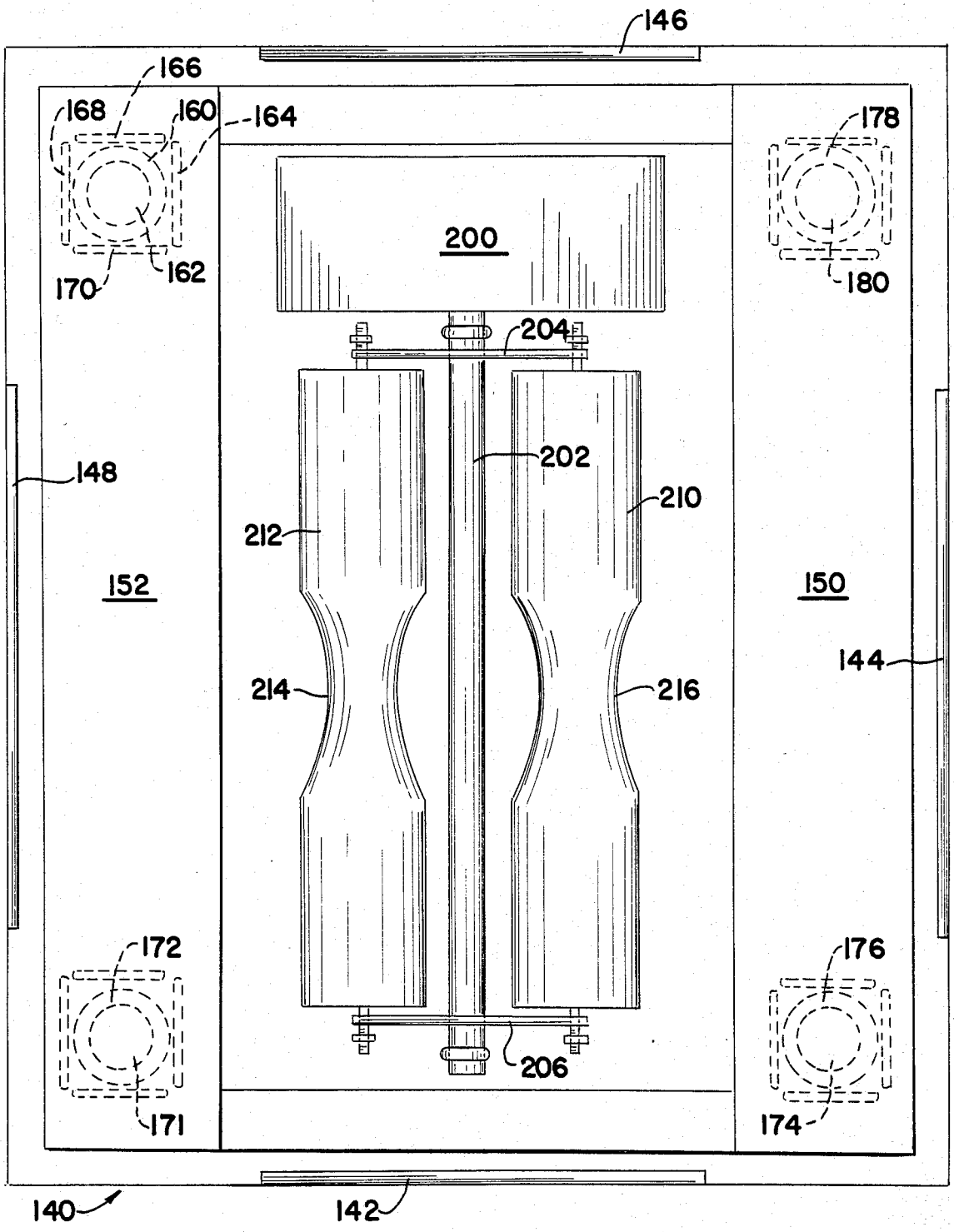
FIG. 6 is a top plan view of a modified embodiment of the present invention.

Referring now to FIG. 6, an embodiment of the invention showing several modified features, any one of which may be employed alone or in combination with one or more features of the hereinbefore-discussed embodiment. In the embodiment of FIG. 6, body support portions 150, 152 are positioned in relative fixed relationship with respect to each other. Peripheral upstanding walls 142, 144, 146, 148 which may be similar in width and height to walls 90, 92 are positioned on four sides of base 140. Relative vertical adjustment between the base 140 an upper portion is provided by feet 160, 172, 176, 178 which have upwardly projecting shank portions, respectively, 162, 171, 174, 180. In this embodiment rather than relying on a pair of generally parallel ribs to resist undesired movement of the feet, each foot is enclosed by a series of four upwardly projecting ribs oriented in generally box-like configuration. For example, foot 160 is surrounded by ribs 164, 166, 168, 170. Similar rib constructions are provided with respect to the other feet 172, 176, 178.

In this embodiment, motor 200 is directly coupled to main drive shaft 202 which establishes through plates 204, 206, which are fixedly secured to drive shaft 202, both orbital and axial rotation of rollers 210, 212. In this embodiment of the invention rollers 210, 212 are provided, respectively, with radially reduced circumferential portions 216, 214. This contour serves to more closely complement the shape of the rear neck portion of the human body.

While the invention may be employed with a wide variety of materials, the rollers may advantageously be composed of a suitable rubber or plastic material or another material having a suitable rubber or plastic exterior covering. The plate members may advantageously be made of steel and welded to main drive shafts. It will be appreciated that while, in a preferred embodiment of the invention, the plates illustrated are employed in connecting the main drive shaft to the roller shafts, other means of effecting this transfer of rotational movement may be employed. For example, gear means may be attached to the main drive shaft and cooperate with gear means secured to the roller member drive shafts. Alternatively, for example, belt and pulley or chain and sprocket drives may be employed.

EXAMPLE

In order to provide further guidance as to a preferred embodiment of the invention, an example will be considered. A base member composed of a suitable material has a length of about 10 inches and a width of about 8½ inches. If the base is made of steel, it has a thickness of about ⅛ to 3/16 inch and has the main drive shaft support and peripheral walls secured thereto. The body support or head rest portions consist of foam rubber pads 8 inches long by 2 inches wide by 1¼ inches high with a lower portion of the supports being made of wood of the same dimensions. The adjustable side members which determine the relative spacing between the two body support portions are made of metal channels. The roller members are 5 inches long and 1 inch in diameter with the main drive shaft having a diameter of approximately ⅛ inch. The headrest members or rollers or both may be covered by a plastic or rubber sheet or an accessory pad approximately ¼ inch thick having a foam rubber interior and a vinyl exterior for increased comfort.

Figure 7:
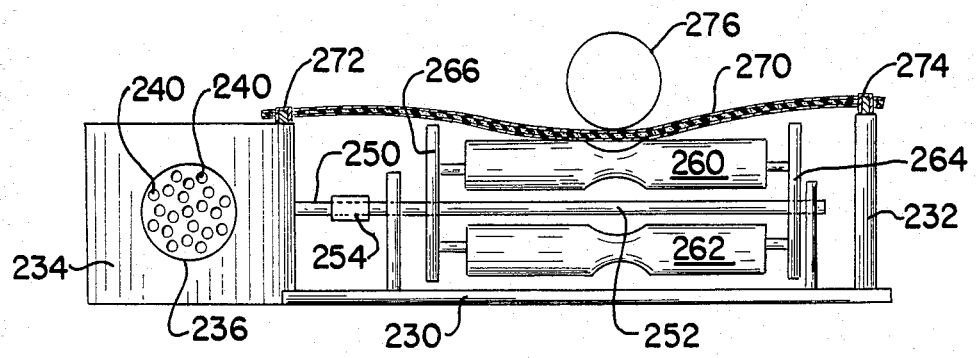
FIG. 7 is a front elevational view partly in section of another embodiment of the invention.
Figure 8:
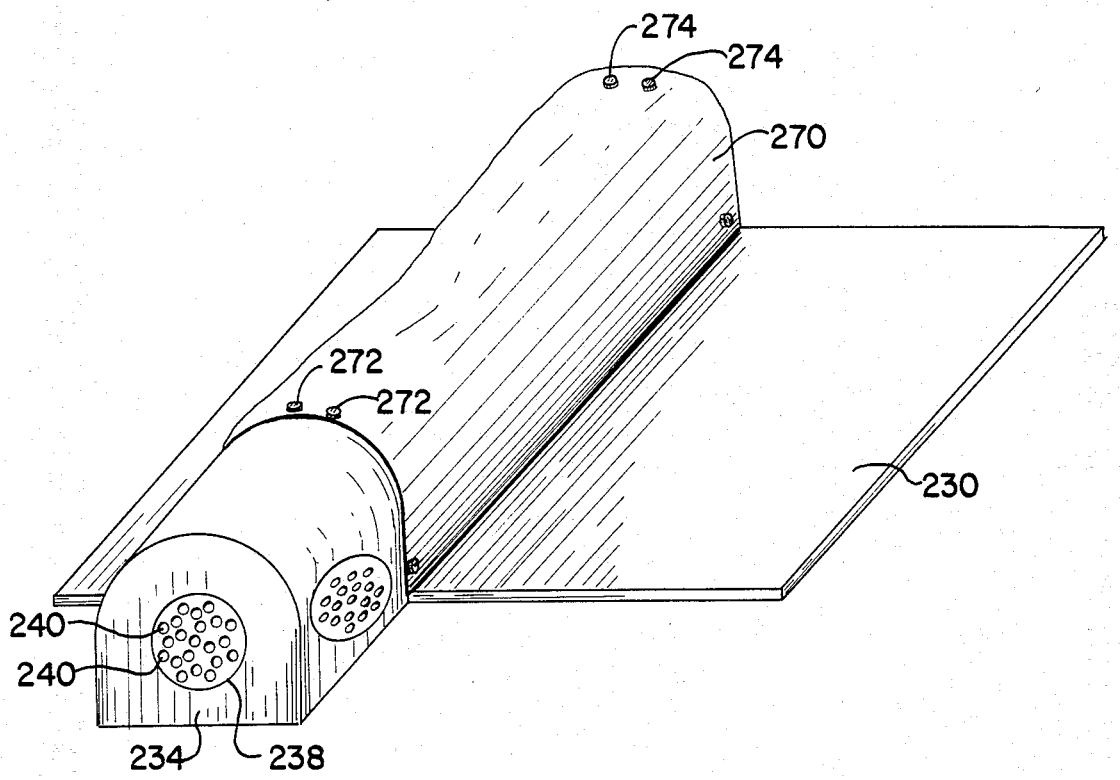
FIG. 8 is a perspective view of the embodiment of FIG. 7.

Referring now to FIGS. 7 and 8, a further embodiment will be considered. In this embodiment the base portion 230, which in the form shown is a substantially rigid plate, having an upstanding sidewall 232 and motor housing 234. The motor housing 234 has a number of ventilation plates 236, 238 each of which has a plurality of openings 240 which permit air flow to cool the motor. The motor output shaft 250 is connected to main drive shaft 252 by coupler 254 in order to permit direct drive of the shaft 252 by the motor (not shown). The body of the user will generally be oriented perpendicularly with respect to the longitudinal axis of the roller members 260, 262. Roller members 260, 262 are supported by plates 264, 266. In this embodiment the body support portion 270 consists of a flexible web, which may advantageously be made of plastic or rubber with or without a resiliently compressible material, is secured in place in the form shown by snap members 272, 274. Circle 276 represents a portion of a human body in overlying contact with support portion 270 while roller member 260 contacts the undersurface thereof. In this embodiment as well as others a variable speed control may be employed, if desired.

If will be appreciated, therefore, that the present invention provides effective means for an individual to self-administer mechanized message to regions of the body which may be difficult to reach under normal conditions employing prior art constructions. More specifically, one of the advantageous uses of the present invention involves placing the body in such position to enable the rollers to apply massaging action in order to relieve muscular tension and vascular irritation in the region of the cervical spine or rear neck. All of this is accomplished in a safe, efficient and economical manner.

Whereas particular embodiments of the invention have been described above for purposes of illustration, it will be evident to those skilled in the art that numerous variations of the details may be made without departing from the invention as defined in the appended claims.

I claim:

1. A massaging device comprising a base portion, an upper portion supported by said base portion, said upper portion having at least one body support portion for supporting a portion of an individual's body, said upper portion having a pair of said body support portions disposed in relative spaced relationship, said pair of spaced body support portions being disposed on opposite sides of said roller members, first adjustment means for adjusting the spacing between said body support portions, a main drive shaft, motor means for rotating said main drive shaft, said main drive shaft being rotatably mounted a fixed distance from said base portion, and a plurality of roller members operatively associated with said main drive shaft for orbital movement therearound responsive to rotation of said main drive shaft, whereby a stationary individual supported by said body support portions with his or her cervical spine region in overlying contacting relationship with respect to said roller members will receive continuous massaging action applied to said region of the body.

2. The massaging device of claim 1 including said first adjustment means being so disposed as to permit one said body support portion to support a portion of a human head and the second said support portion to support another portion of the body so as to expose a portion of the cervical spine to contact with said roller members.

3. The massaging device of claim 2 including said body support portions each having a substantially rigid base portion and a generally resilient upper portion.

4. The massaging device of claim 1 including second adjustment means for permitting relative vertical adjustment between said base portion and said body support portions.

5. The massaging device of claim 4 including plate means rigidly secured to said main drive shaft, and said roller members rotatably secured to said plate member, whereby rotation of said main shaft will establish rotation of said plate with said shaft and responsive orbital movement of said roller member about said main drive shaft.

6. The massaging device of claim 5 including said roller members being disposed in surrounding relationship with respect to individual roller member shafts and being fixedly secured to said shaft members, and said roller member shafts being rotatably secured to said plate means.

7. The massaging device of claim 5 including said roller members being disposed in surrounding relationship with respect to individual roller member shafts and being rotatably secured with respect to said roller member shafts.

8. The massaging device of claim 1 including said first adjustment means having means for relative positioning of said body support members at relative positions.

9. The massaging device of claim 4 including said second adjustment means including threaded feet received within threaded bores of said body support members.

10. The massaging device of claim 1 including said roller members having at least one portion of radially restricted circumference.

11. The massaging device of claim 1 including said base portion having upwardly projecting retainer wall means for resisting undesired displacement of said upper portion with respect to said base portion.

12. The massaging device of claim 1 including speed reduction means interposed between said motor and said main drive shaft.

13. Massaging device comprising a base portion, a body support portion for supporting only that portion of an individual body which will receive massaging action, a main drive shaft, motor means for rotating said main drive shaft, said main drive shaft being rotatably mounted a fixed distance from said base portion, a plurality of roller members operatively associated with said main drive shaft for orbital movement therearound in a fixed path with respect to said base portion responsive to rotation of said main drive shaft, whereby a stationary individual supported by said body support portion with his or her cervical spine region in overlying contacting relationship with respect to said roller members will receive continuous massaging action applied to said region of the body, said body support portion having a flexible web in overlying position with respect to said roller members, said flexible web being secured in fixed position with respect to said base portion, and said flexible web being of such size and shape as to provide effective support to said cervical spine, whereby said stationary individual will have said flexible web interposed between the cervical spine region and said roller members.

14. The massaging device of claim 13 including stationary means in overlying contact with respect to said roller members.

15. The massaging device of claim 13 including said base portion having a generally platelike base, sidewall and a motor housing, and said body support portion removably secured to said base portion.

16. The massaging device of claim 15 including said body support portion having a pair of plastic skin portions and an interposed resiliently compressible material.

* * * * *

UNITED STATES PATENT AND TRADEMARK OFFICE

CERTIFICATE OF CORRECTION

PATENT NO. : 4,506,660

DATED : March 26, 1985

INVENTOR(S) : William F. Curran

It is certified that error appears in the above-identified patent and that said Letters Patent is hereby corrected as shown below:

Column 1, line 22, "well" (second occurrence) should be --and--.

Column 6, line 2, "1/8 inch" should be --3/8 inch--.

Claim 8, line 3, --discrete-- should be inserted before "relative".

Claim 14, line 2, --cover-- should be inserted before "means".

Signed and Sealed this

*Sixth* Day of *August 1985*

[SEAL]

*Attest:*

DONALD J. QUIGG

*Attesting Officer* *Acting Commissioner of Patents and Trademarks*

REEXAMINATION CERTIFICATE (1139th)

United States Patent [19]

Curran

[11] B1 4,506,660

[45] Certificate Issued Oct. 10, 1989

[54] MASSAGING DEVICE

[76] Inventor: William F. Curran, 85 Dobson Rd., Mars, Pa. 16046

Reexamination Request:
No. 90/001,523, Jun. 13, 1988

Reexamination Certificate for:

| | |
|---|---|
| Patent No.: | **4,506,660** |
| Issued: | **Mar. 26, 1985** |
| Appl. No.: | **360,791** |
| Filed: | **Mar. 22, 1982** |

Certificate of Correction issued Aug. 6, 1985.

Related U.S. Application Data

[63] and a continuation-in-part of Ser. No. 264,432, May 18, 1981, abandoned.

[51] Int. Cl.[4] ..... A61H 15/00
[52] U.S. Cl. ..... 128/57; 128/24.3
[58] Field of Search ..... 128/24.3, 24.4, 45–47, 128/56, 57, 59, 70, 33

[56] References Cited

U.S. PATENT DOCUMENTS

| | | | |
|---|---|---|---|
| 2,003,272 | 5/1935 | Betz | 128/59 |
| 2,193,882 | 3/1940 | Petersen | 128/70 |
| 2,384,427 | 9/1945 | Andis | 128/57 |
| 2,446,098 | 7/1948 | Niblack | 128/57 |
| 2,629,374 | 2/1953 | Acerbi | 128/57 |
| 3,297,024 | 1/1967 | Robinson | 128/38 |
| 3,398,741 | 8/1968 | Burk | 128/57 |
| 3,882,856 | 5/1975 | Heuser et al. | 128/57 |
| 3,998,218 | 12/1976 | Lane et al. | 128/70 |
| 4,127,116 | 11/1978 | Pannetier | 128/57 |
| 4,190,043 | 2/1980 | Thompson | 128/33 |

FOREIGN PATENT DOCUMENTS

| | | | |
|---|---|---|---|
| 2947277 | 5/1981 | Fed. Rep. of Germany | 128/57 |
| 3026941 | 2/1982 | Fed. Rep. of Germany | 128/57 |
| 3036467 | 5/1982 | Fed. Rep. of Germany | 128/57 |
| 3105161 | 8/1982 | Fed. Rep. of Germany | 128/57 |

*Primary Examiner*—R. J. Apley
*Assistant Examiner*—John Welsh

[57] ABSTRACT

A massaging device adapted to engage and apply massaging action to a supported body portion, such as the rear neck or cervical spine. The massaging device may have a base portion and an upper portion supported by the base portion. An upper portion has a body support portion. The upper portion in one form has a pair of spaced body support portions disposed on opposite sides of a plurality of roller members which are operatively associated with a main drive shaft driven by a motor with or without interposed speed reduction means. The body support portions are adapted to be adjusted in respect of relative spacing therebetween. Adjusting of the relative height of the body support portions with respect to the base portion and as a result with respect to the roller members may also be provided. Another embodiment has a body support portion in overlying contact with the roller members.

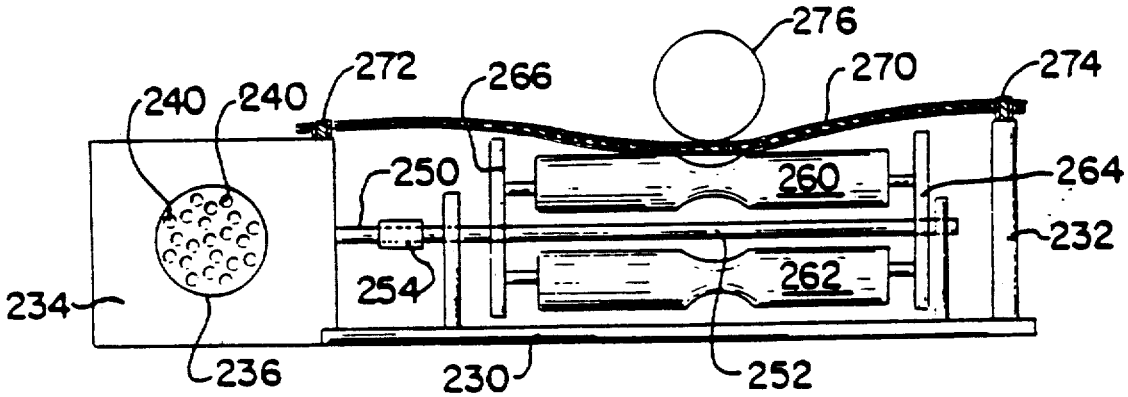

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 6, lines 7–29:

Referring now to FIGS. 7 and 8, a further embodiment will be considered. In this embodiment the base portion 230, which in the form shown is a substantially rigid plate, *has* [having] an upstanding sidewall 232 and motor housing 234. The motor housing 234 has a number of ventilation plates 236, 238 each of which has a plurality of openings 240 which permit air flow to cool the motor. The motor output shaft 250 is connected to main drive shaft 252 by coupler 254 in order to permit direct drive of the shaft 252 by the motor (not shown). The body of the user will generally be oriented perpendicularly with respect to the longitudinal axis of the roller members 260, 262. Roller members 260, 262 are supported by plates 264, 266. In this embodiment the body support portion 270 consists of a flexible web, which may advantageously be made of plastic or rubber with or without a resiliently compressible material [,]. *The flexible web* is secured in place in the form shown by cap members 272, 274. *Body support portion 270 may comprise a pair of plastic skin portions and an interposed resiliently compressible material.* Circle 276 represents a portion of a human body in overlying contact with support portion 270 while roller member 260 contacts the undersurface thereof. In this embodiment as well as others a variable speed control may be employed, if desired.

AS A RESULT OF REEXAMINATION, IT HAS BEEN DETERMINED THAT:

Claim 14 is cancelled.

Claims 1, 13, 15 and 16 are determined to be patentable as amended.

Claims 2–12, dependent on an amended claim, are determined to be patentable.

1. A massaging device comprising a base portion, an upper portion supported by said base portion, said upper portion having at least one body support portion for supporting a portion of an individual's body, said upper portion having a pair of said body support portions disposed in relative spaced relationship,

[said pair of spaced body support portions being disposed on opposite sides of said roller members,]

first adjustment means for adjusting the spacing between said body support portions, a main drive shaft, motor means for rotating said main drive shaft, said main drive shaft being rotatably mounted a fixed distance from said base portion, [and]

a plurality of roller members operatively associated with said main drive shaft for orbital movement therearound responsive to rotation of said main drive shaft, *and*

*said pair of spaced body support portions being disposed on opposite sides of said roller members,* whereby a stationary individual supported by said body support portions with his or her cervical spine region in overlying contacting relationship with respect to said roller members will receive continuous massaging action applied to said *cervical spine* region [of the body].

13. *A cervical spine* [Massaging] *massaging* device comprising a base portion, a *cervical spine* [body] support portion for supporting only that portion of an [individual] *individual's cervical spine area* [body] which will receive massaging action, a main drive shaft, a motor means for rotating said main drive shaft, said main drive shaft being rotatably mounted a fixed distance from said base portion, a plurality of roller members operatively associated with said main drive shaft for orbital movement therearound in a fixed path with respect to said base portion responsive to rotation of said main drive shaft, whereby a stationary individual supported by said [body] *cervical spine* support portion with his or her cervical spine *area* [region] in overlying contacting *supported* relationship with respect to said roller members will receive continuous massaging action applied to said *area* [region] of the body, said [body] *cervical spine* support portion having a flexible web in overlying position with respect to said roller members, said flexible web being secured in fixed position with respect to said base portion, and said flexible web being of such size and shape as to provide effective support to said cervical spine *area*, whereby said stationary individual will have said flexible web interposed between [the] *said* cervical spine *area* [region] and said roller members.

15. The *cervical spine* massaging device of claim 13 including said base portion having a generally platelike base, sidewall and a motor housing, and said *cervical spine* [body] support portion removably secured to said base portion.

16. The *cervical spine* massaging device of claim 15 including said *cervical spine* [body] support portion having a pair of plastic skin portions and an interposed resiliently compressible material.

* * * * *